United States Patent [19]

Ibanez

[11] Patent Number: 4,903,741

[45] Date of Patent: Feb. 27, 1990

[54] PNEUMATIC ACTION DISPENSER FOR FILLING BOTTLES WITH SODA AND CARBON DIOXIDE

[75] Inventor: Alberto A. Ibanez, Nogoya, Argentina

[73] Assignee: Industrias Marsel S.A.I.C.I.A., Nogoya, Argentina

[21] Appl. No.: 134,396

[22] Filed: Dec. 17, 1987

[30] Foreign Application Priority Data

Dec. 22, 1986 [AR] Argentina ..... 306,293

[51] Int. Cl.[4] ..... B65B 3/04

[52] U.S. Cl. ..... 141/350; 141/21; 141/46; 141/113; 141/349; 137/614.04

[58] Field of Search ..... 141/20, 21, 348, 115, 141/16, 113, 319, 320, 321, 322, 349, 350, 22, 14, 46; 137/614.04, 614.03

[56] References Cited

U.S. PATENT DOCUMENTS

| | | | |
|---|---|---|---|
| 3,176,727 | 4/1965 | Rousseau | 141/349 |
| 3,354,916 | 11/1967 | Ruscitti | 141/20 |
| 3,572,402 | 3/1971 | Beffel | 141/113 |
| 4,304,272 | 12/1981 | Golding | 141/113 |

FOREIGN PATENT DOCUMENTS

| | | | |
|---|---|---|---|
| 1284503 | 1/1987 | U.S.S.R. | 4/615 |

*Primary Examiner*—Henry J. Recla
*Assistant Examiner*—Daniel Stein-Freer
*Attorney, Agent, or Firm*—Kuhn & Muller

[57] ABSTRACT

A pneumatic action dispenser for filling bottles with soda and carbon dioxide according to alternate mixing sequences, where each bottle has a normally closed closure valve in its neck, said dispenser being engageable with the neck of the bottle and provided with a pneumatically and coaxially activated mobile body which contains another body mobile with respect to the other, said second mobile body having a mouthpiece engageable with the bottle which is provided with a central opening for a member capable of opening the valvular closure of the bottle and which is in communication with an inlet and/or outlet connector for carbon dioxide and soda. The main pneumatically activated mobile body includes a member for opening the valvular closure of the bottle, the activation of which opens a closure valve within the dispenser between the main and second mobile bodies in the communication line for the fluid feed.

3 Claims, 4 Drawing Sheets

PNEUMATIC ACTION DISPENSER FOR FILLING BOTTLES WITH SODA AND CARBON DIOXIDE

FIELD OF THE INVENTION

The present invention relates to a pneumatic dispenser for filling bottles or the like, with an intimate mixture of soda and carbon dioxide ($CO_2$) providing a number of advantages, some of the outstanding ones related to economic aspects and operational speed.

BACKGROUND OF THE INVENTION

The commercial preparation of soda mixed with carbon dioxide has hitherto taken place in two ways, namely: by the use of bottles provided with closing stoppers resistant to the internal pressure or by means of siphons or containers provided with heads having hermetic valvular closures to be activated by manual finger levers and supplemented with discharge tubes and ejector nozzles.

The use of bottles with pressure stoppers presents the drawback that opening the container for the first time is sufficient to cause the escape of all the gas or most of it, losing almost the entire content of effervescence which is not consumed at that moment. When the same bottle is again opened to consume the remainder of the beverage, a substantial difference is observed. For this reason, a preference exists for the use of siphon head bottles.

Nevertheless, although siphon bottles provide products of better grade, they present the disadvantage of requiring the simultaneous use of as many heads as containers, or bottles, as are in circulation in the homes of consumers, in wholesale and retail sales stores, in soda factories, in distributor vehicles, warehouses, etc., which results in a high cost for commercial exploitation and to the public, for which reasonable concern developed for eliminating or reducing as much as possible the use of such heads and bottles without thereby abandoning the advantage of the consumption of said gassed beverages.

Such concern began to encounter a favorable solution with the recent appearance of containers such as bottles provided with a normally closed valvular closure agent in their neck which only permits the entry or outlet of liquids and gas by means of an external force; said valvular closure agent being in direct communication with a discharge tube which reaches almost to the bottom of the bottle from the neck.

The external force consists in pressing the valvular closure for its opening, both when it is desired to consume the product thus packed and when the container is filled with soda and gas. Such new containers with valve and discharge tube are adapted for use with the temporary addition of activating heads similar to those known in siphons but with simple adaptations for placement in the following way: an activating head in each dwelling of consumers to be positioned and withdrawn from successive containers when they are being used, and another head or a smaller number of heads which are only positioned during the filling process in each soda or bottling plant.

The necessary quantity of heads with ejector nozzles and levers is greatly reduced in this way, consequently achieving a substantial economy for producers and for consumers.

Filling of containers in factories or bottling plants with soda and gas currently tends to be done with the use of known rotary filling machines for siphon units, where these new containers, which enter and leave without siphon heads, are provided with heads during the passage through these machines only for that filling.

Although satisfactory results are obtained, the outputs are affected by the resulting need to add stages for the placement and later removal of a head from each container during the process. Cumulative delays are unavoidable under such conditions.

SUMMARY OF THE INVENTION

All the difficulties mentioned are solved with the dispenser of the present invention since, in addition to permitting the use of the known rotary and continuous filling machines, the dispenser eliminates the need for the temporary placement of a head such as is known for siphons on each bottle, to be removed later for its reuse on another bottle to be filled, and so on.

With the dispenser of this invention, containers enter directly into the filling zone without any prior addition, where they are received and filled in the same way as with bottles permanently provided with siphon heads, and finally they are delivered for later forms of shipping, packaging, etc. without any need to remove anything from them.

This means that the filling stage is direct, and it is conducted as if filling takes place with conventional siphon bottles permanently provided with their own inseparable siphon heads at a rate of one per container, since the need for the additional steps of applying and removing special heads before and after filling is eliminated.

These advantageous results are the direct consequence of the novel concept provided in the functioning and application aspects of the dispenser of the invention, which comprises a combination of dispenser units attachable to filling machines at a rate of one for each reinforcing support for containers to be filled, and which includes a body provided with an upper mouthpiece which fits the neck of the bottle to be filled and a conventional supply connector for supplying selective sequences of soda and gas under pressure wherein a normally closed and pneumatically activated valvular stopper is interposed therebetween.

In their turn, the activating pneumatic units are equipped for approaching and connecting the mouthpiece of this dispenser with the neck of a bottle so that, when all the conventional stages of filling by sequences have been completed, the pneumatic units release the neck of the bottle for withdrawal from the filling mouthpiece of this dispenser.

This means that, in addition to the sequential supply hose for carbon dioxide and soda under pressure, the dispenser is connected to lines capable of providing it with two separate compressed air sources adequately provided with respective closure and opening units in order to activate a double-action piston which moves in opposite directions in a pneumatic cylinder, preferably located in the body of the dispenser, thus providing two operational positions: one for connecting the bottles with the supply sources, and the other for closing the connection between said sources and the bottles for the purpose of withdrawing same and making it possible to place further bottles to be filled.

The normally closed valvular closure stopper in the dispenser of the invention is in one piece with a thin coaxial pressure finger which, when activated, emerges through the center of the outlet mouthpiece of the dispenser, protruding to the extent necessary to thrust at and open the appropriate known valvular closure unit in the neck of a bottle.

Under the conditions presented, the soda and carbon dioxide supply sources are put in a position of mutual communication with the interior of the container to be filled with a simple and adequate pneumatic command, this by opening the valvular closure unit within the dispenser and with a simultaneous thrust of the valvular stopper of said container, this communication needing to be kept uninterrupted while the already mentioned and known sequential filling stages are performed. When said filling has terminated, the pneumatic command units again close said communications, and so on.

In order to more concretely demonstrate the foregoing features and advantages of the invention, to which users and experts in the art may add many more, and to facilitate understanding of the constructional, component and functional characteristics of the dispenser of the invention, reference is made to the following more detailed description of the invention together with the attached drawing, with the express statement that, no limitation should be attributed to them affecting the scope of protection of the present invention.

PREFERRED EMBODIMENTS OF THE INVENTION

The same or equivalent parts or component elements of the examples selected for the present explanation of the present invention bear equal reference numbers in all figures.

Figure 1:
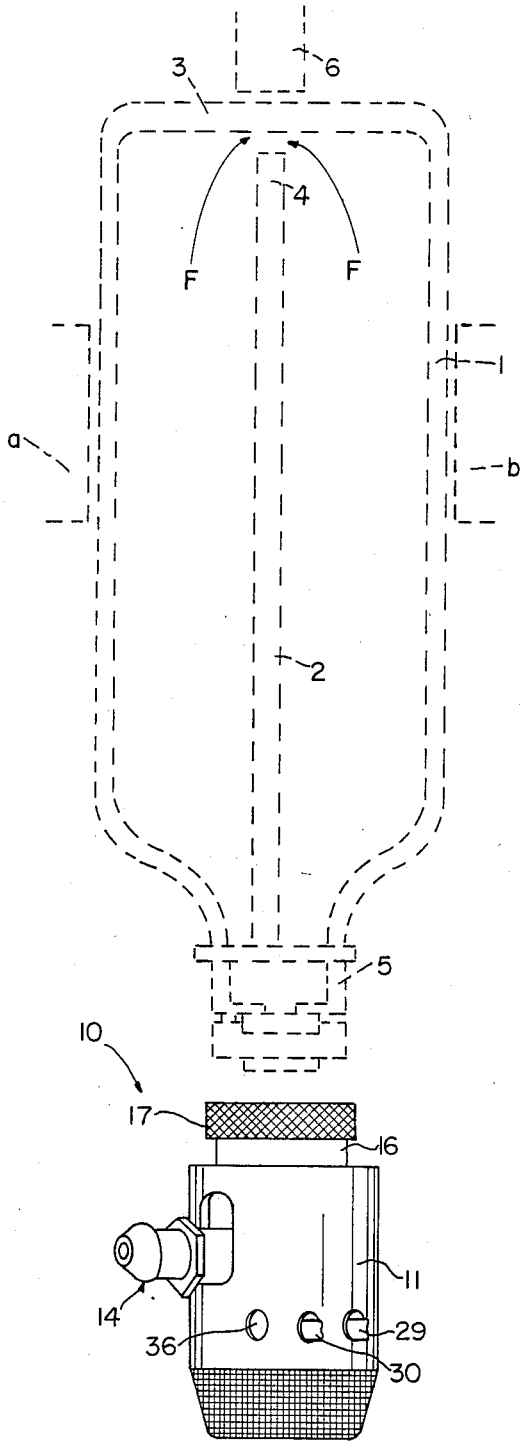
FIG. 1 is a schematic elevation view, part in persepctive, of a soda and gas dispenser in accordance with the invention disposed adjacent a bottle of the type that is utilized with this invention provided in its neck with a normally closed valvular closure stopper, both the bottle and the dispenser being in a relative position permitting approach and connection for filling.
Figure 2:
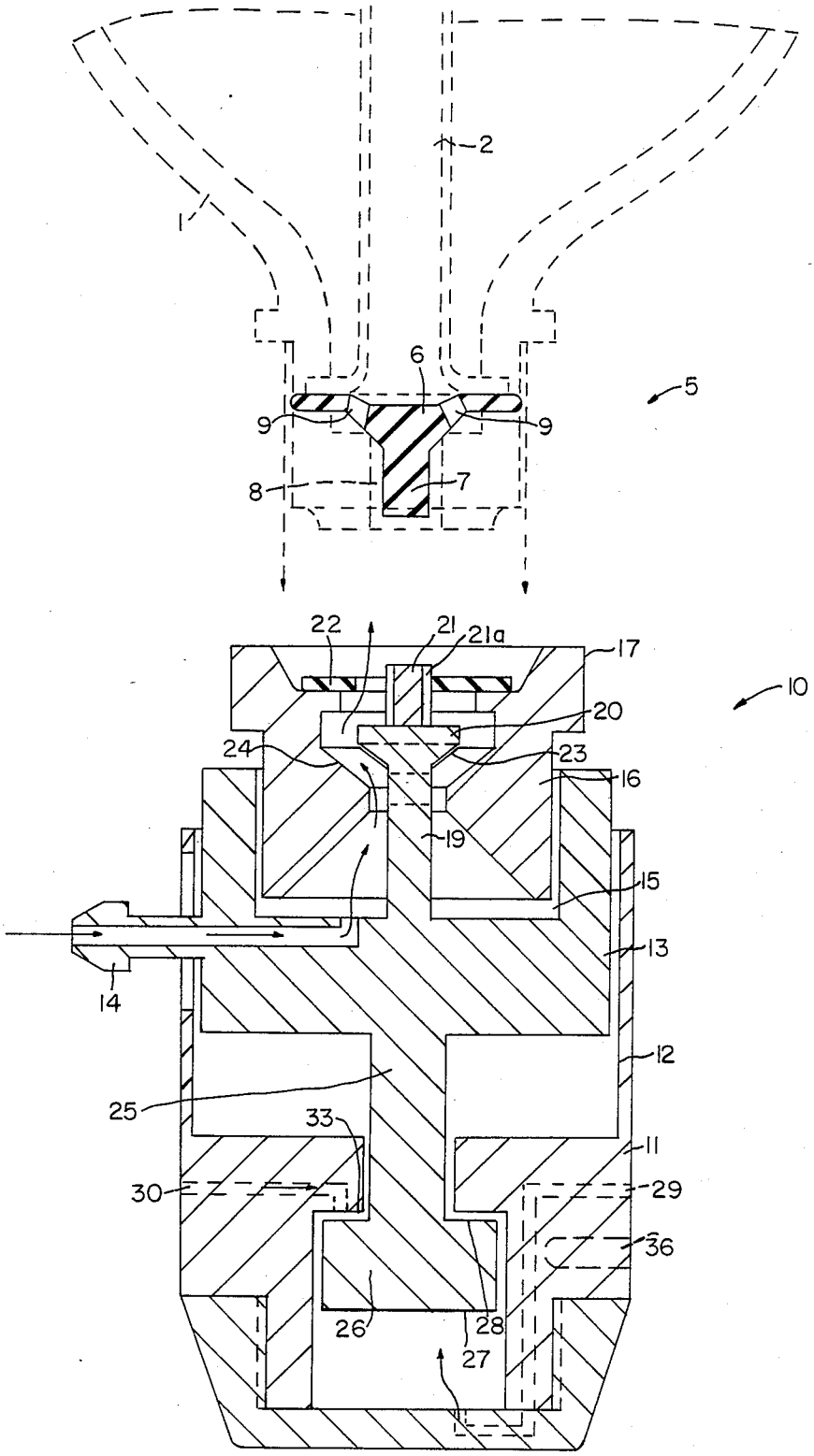
FIG. 2 is an enlarged cross-section view, of the dispenser of FIG. 1 placed at the neck portion of the bottle of FIG. 1.

As can be seen in FIGS. 1 and 2, the container to be filled using the dispenser of this invention is the known type consisting of a bottle or carafe 1, in position for filling, with its neck down, in order for the internal discharge tube 2, which does not extend to touch the bottom 3 of the bottle, to have its free end 4 oriented upward in order for the return carbon dioxide to be able to enter said tube according to arrows F, whenever necessary. The discharge tube 2 communicates in the neck 5 of the bottle 1 with a valvular closure unit 6 which is normally closed, as is schematically shown by means of its elastic body. The closure unit 6 is deformable by a thrust from outside on a rod 7 extending therefrom which is located in the center of the mouth of the neck 5 of the bottle 1, with a gap 8 surrounding it which, due to the elasticity of the closing unit body, is permanently closed against surrounding internal lips. A number of holes 9 through the closure unit body 6 which converge on the longitudinal axis of the discharge tube 2 permit communication of the interior of discharge tube 2 with the gap 8 for entry or expulsion of fluids from the bottle 1. These holes 9 permit communication with discharge tube 2 only when rod 7 is pressed against tube 2; on the other hand, the contents in the bottle 1 are confined and have no outlet through the neck even when the unit is turned upside down. Conventional support elements indicated by a, b and c are shown supporting the bottle 1 in its inverted filling position.

The dispenser of the invention indicated generally by reference numeral 10 consists of a substantially cylindrical and hollow element 11, in the interior 12 of which a mobile body element 13 moves and which, by means of an appropriate connection pick 14, receives the sequential and conventional feeding of soda and carbon dioxide. Another coaxial cavity 15 is formed in one end of the mobile body element 13 within which cylindrical body element 16 moves independently. Cylindrical body element 16 is formed with the mouthpiece 17 in the end thereof, where when bottles 1 are being filled, each respective neck of such bottles are partially received, as can be seen in FIG. 2.

The mobile body element 13 is formed with upper rod 19 upon which valvular stopper 20 is supported and which ends with thrust finger 21, preferably reinforced with side elements 21*a*. The thrust finger 21 passes through the central hole of elastomeric washer 22 located within the mouthpiece 17 cavity for receiving the necks of bottles 1. The surface of valvular stopper 20 can include some optional conical lining or the like 23, to provide for a closure valvular seat to be produced when the surface thereof comes in contact with a constriction 24 formed within mobile body 16.

Mobile body element 13 is connected to double-acting piston 26 through axial rod 25 to effect the pneumatic activation thereof by means of compressed air being selectively fed to one or the other of the opposite surfaces 27 and 28 of the piston 26 through respective external compressed air inlets 29 and 30. When air entering through port 29 circulates, pressure is exerted against surface 27, compelling the rise of piston 26 and consequently of mobile body 13 with all its accessories 14, 16, 17, 20, 21 and 22 until the washer 22 stops at the neck 5 of the bottle 1, at which moment only the rise of mobile body 13 can continue. Thrust by the pressure of compressed air entering through port 29, the stopper 20 opens, and finger 21 is thrust upward, which causes the opening of valve 6 in the neck of bottle 1 facilitating the filling of container 1. Alternatively, when compressed air entering through port 30 circulates, pressure is exerted against surface 28 of piston 26, and the descent of piston 26 and mobile body 13 with all its accessories begins until the gasket 22 separates from neck 5 of bottle 1, at which moment the pressure of the filling fluids entering through pick 14 thrusts cylindrical body element 16 upward, causing the closure of valve stopper 20.

Figure 3:
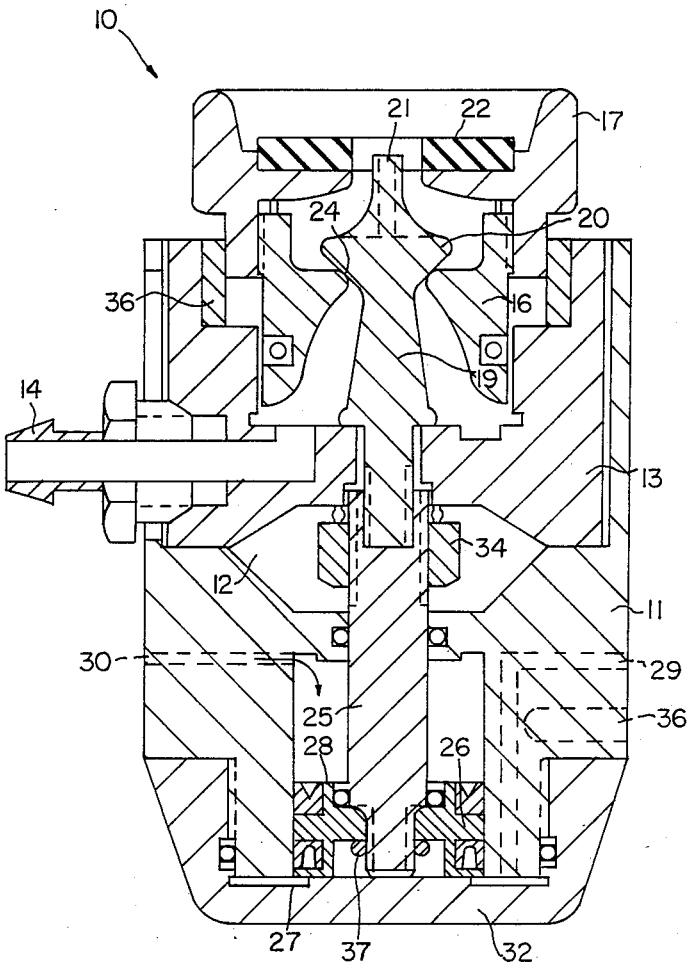
FIG. 3 is a cross-section view of an alternate embodiment of the dispenser of the invention shown in closed position, which does not permit dispensing soda or carbon dioxide.
Figure 4:
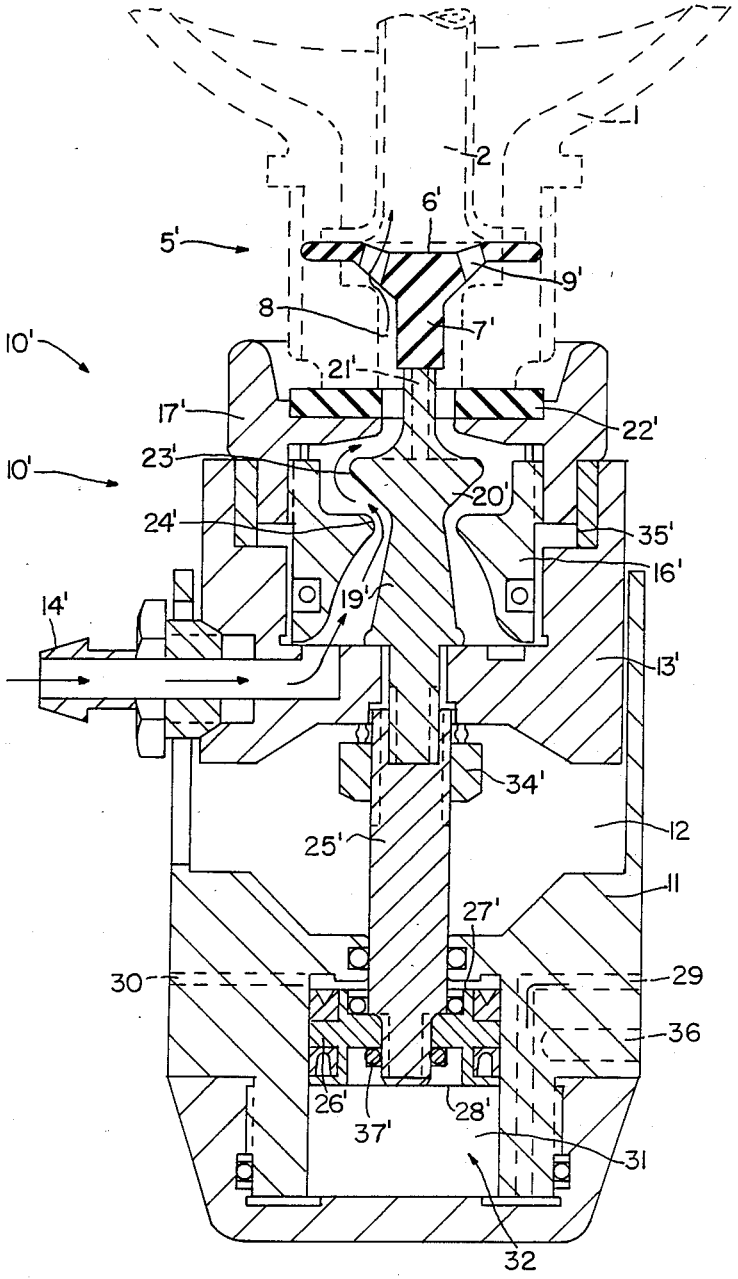
FIG. 4 is a cross-section view of the dispenser of FIG. 3 in engagement with the neck of a bottle of the type that is utilized with this invention under conditions such as to permit filling the bottle with the closure units of the dispenser being open, as is the valvular closure of said container.

Referring now to FIGS. 3 and 4, it can be observed that cylindrical body element 16 is solidly attached by screwing to a collar forming a mouthpiece 17 with an elastomeric doughnut-shaped lining 22 known as an o-ring therebetween. Cylindrical body element 16 at the same time has a substantially truncated conical cavity whose lesser section corresponds to constriction 24, which forms a part of the valvular closure in conjunction with valvular stopper 20. Valvular stopper 20 is integrally formed with rod 19 which in turn, is removably secured with respect to lower coaxial rod 25, and connected by means of a nut 37 with mobile double acting piston 26 provided with conventional hermetic seals 27 and with mobile body element 11 by nut 34.

In FIG. 3 elements have been illustrated directly with numbers, whereas in FIG. 4 all elements which change position when the dispenser is in container-filling condition are indicated with the same numerical references by the addition of a "prime" so that the parts in FIG. 4 which do not have these "primes" should be considered as not moving when the position change is made.

It can also be seen in both FIGS. 3 and 4 that cylindrical body 16 has its truncated conical cavity facing the circulation course through which soda and carbon dioxide enter, producing a thrust which tends to keep constriction 24 closed, whereas piston 26, which is located below, can overcome this thrust by the upward force exerted on the piston 26 when compressed air is received through passage 29, passing to the position illustrated in FIG. 4.

As shown in said FIG. 4, piston 26' has reached the upper course stop within chamber 31 of hollow element 11, driving coaxial rod 25', and the latter with nut 34' will have driven mobile body 13' together with rod 19'. At the same time, finger 21' which extends outwardly from valvular stopper 20' engage with the end of rod 7' to cause the opening of valvular closure 6' within the neck 5' of the bottle 1 to be filled. Moreover, the resistance offered by substantially rigid container 1 causes a stop on the displacement of mouthpiece collar 17' together with cylindrical body element 16', whereas valvular stopper 20' thrust by rod 19' will continue to advance, giving rise to opening of the constriction 24', thus permitting the upward passage of fluid under pressure coming from 14', whether gas or soda, for the filling of the appropriate bottle.

In FIGS. 1 to 4, the threaded holes 36 are provided for attaching cylindrical element 11 of the dispenser 10 at any appropriate place with respect to the corresponding support (a), (b) or (c) of the bottle in a filling machine where the dispenser of the invention may be used.

As would be evident to those skilled in the art, the pneumatic dispenser unit of the present invention may be used in any one of the conventional rotary filling units that are known and used for filling syphon head bottles and the like including those disclosed, for example in copending application Ser. No. 947,658 filed Dec. 20, 1986 and in U.S. Pat. No. 4,617,973.

Any conventional and well known apparatus including pressure and time controls for compressed air may be used in the dispenser of the invention as, for example, fed to connectors 29 and 30 of the dispenser and further description should not be necessary for one having skill in the art to understand and operate such dispenser. The supply soda and carbon dioxide to conventional connector pick 14 of the dispenser is also well known and any one of such conventional means of supply may be used in accordance with the invention.

When the dispenser thus described and illustrated is used in practice, it will be possible to introduce modifications and/or improvements, all of which should be considered variations included within the scope of the present invention, which is limited only by the spirit of the following claims.

What is claimed is:

1. Pneumatic action dispenser for filling bottles with soda and carbon dioxide where each of said bottles has a normally closed valvular closure unit in a neck thereof which is openable by pressing a coaxial rod located in the central zone of the neck, this unit being supplemented with a discharge tube within the bottle which extends coaxially until near the bottom of the bottle without touching it, said dispenser comprising a hollow body with an open end and a closed end in whose interior are two coaxial cavities, the first cavity located near the closed end of said hollow body, and the second cavity near the open end of said hollow body, within which a single mobile body within both cavities moves in two opposite directions by the action of a double-action pneumatic unit comprising a piston formed on an end of said mobile body which is located in one of said cavities, which cavity is in communication with compressed air means which actuates the axial movement of said piston and said mobile body, provided with a side inlet extending through said hollow body and connected to said mobile body, said inlet comprising a connector for a hose for the feed or return of soda and carbon dioxide, and with a mouthpiece slidably mounted within the opposite end of said mobile body and extending from the open end of said hollow body, including bottleneck connection means, connectable by axial placement thereof with respect to a neck of said bottle, said mouthpiece including a passage communicating between said side inlet and said bottleneck connection means, valve means mounted in said passage and activated in response to movement of said mouthpiece with respect to a neck of said bottle, said valve means including a thrust finger extending therefrom and capable of being placed against the rod in the central zone of the neck of said bottle to actuate said valve means.

2. Dispenser in accordance with claim 1, wherein said mobile body comprises a first portion defining a chamber therein in which said mouthpiece is slidably mounted, said mouthpiece having said bottleneck connection means on one end thereof and defining a pressure surface on the opposite end thereof, forming a conical wall of said chamber, said passage in said mouthpiece, said thrust finger connected to said mobile body and extending through said valve seat, said valve means further including a valve head on said thrust finger, whereby said valve head and seat are moved toward each other when said chamber is pressurized and are separated when said mouthpiece is moved with respect to said mobile body.

3. Dispenser in accordance with claim 1, wherein the mouthpiece comprises a piston located within a coaxial chamber in said mobile body which moves in two opposite directions from an end of said hollow body opposite the closed end thereof.

* * * * *